United States Patent [19]

Hsu

[11] 4,114,793

[45] Sep. 19, 1978

[54] MULTI-PURPOSE STAPLER

[75] Inventor: Sheau-Po Hsu, Hu Wei Town, Taiwan

[73] Assignee: EIC International Corporation, Taipei, Taiwan

[21] Appl. No.: 802,447

[22] Filed: Jun. 1, 1977

[51] Int. Cl.[2] ..... B25C 11/00

[52] U.S. Cl. ..... 227/63; 227/76

[58] Field of Search ..... 227/63, 76

[56] References Cited

U.S. PATENT DOCUMENTS

| | | | |
|---|---|---|---|
| 2,102,087 | 12/1937 | Pankonin | 227/63 |
| 3,951,325 | 4/1976 | Mitsuhashi | 227/76 |
| 4,002,281 | 1/1977 | Hsu | 227/63 |

*Primary Examiner*—Granville Y. Custer, Jr.
*Attorney, Agent, or Firm*—Burns, Doane, Swecker & Mathis

[57] ABSTRACT

A multi-purpose stapler is provided comprising a stapling means, a staple removing means and a hole punching means with shiftable actuator mounted on a common base. An actuator is provided which is movable between first and second positions. In the first position of the actuator, downward movement of a press handle of the stapler is limited so that stapling cannot occur but punching and staple removing can occur. In the second position of the actuator stapling can occur. The actuator functions to depress a punch rod when in its first position.

3 Claims, 5 Drawing Figures

MULTI-PURPOSE STAPLER

FIELD OF INVENTION

The present invention relates generally to a stapler and more particularly to a multi-purpose stapler, a staple clinching die, a pinchers type staple remover and a hole punch with shiftable actuator all disposed on a common base and operable with the same handle. When the punching actuator is shifted forward to a suspension position, only the stapler is capable of serving its purpose. When the punching actuator is shifted rearward, both the punch and the staple remover work for their respective functions.

BACKGROUND OF THE INVENTION

A stapler, hole punch and staple remover are necessary items for office work. Such items individually would occupy substantial desk space. Therefore, a multi-purpose item that can perform all of these functions is desirable to eliminate such shortcomings. A U.S. Pat. No. 4,002,281 was granted to the present inventor for a stapler having a shiftable stapling blade with a staple remover and a hole punch mounted on a same. This structure is by no means perfect, because the shiftable blade therein is liable to glide back and forth after a considerable time of use when the slide button of the shifter becomes loose. Thus, there is still a need for an improved multi-purpose stapler.

SUMMARY OF INVENTION

Therefore, a main object of the present invention is to provide a novel multi-purpose stapler having a hole punch under the rear center of the stapler with shiftable punching actuator and a staple remover at the frontmost portion of the stapler. When the shiftable punching actuator is moved forward to a suspension position and locked therein, only the stapler is capable of serving its purpose. When the punching actuator is shifted rearward, either the punch or the staple remover operate for their respective purposes.

Another object of the present invention is to provide a multi-purpose stapler wherein the staple removing function is accomplished with a pair of pinchers which are actuated by the press handle of the stapler.

Still another object of the present invention is to provide a multi-purpose stapler which is so disposed as to provide a compact construction without occupying substantial desk space.

Other objects and features of the present invention will become apparent from the following detailed description to be taken in conjunction with the annexed drawings.

DETAILED DESCRIPTION OF PREFERRED EMBODIMENT

Figure 1:
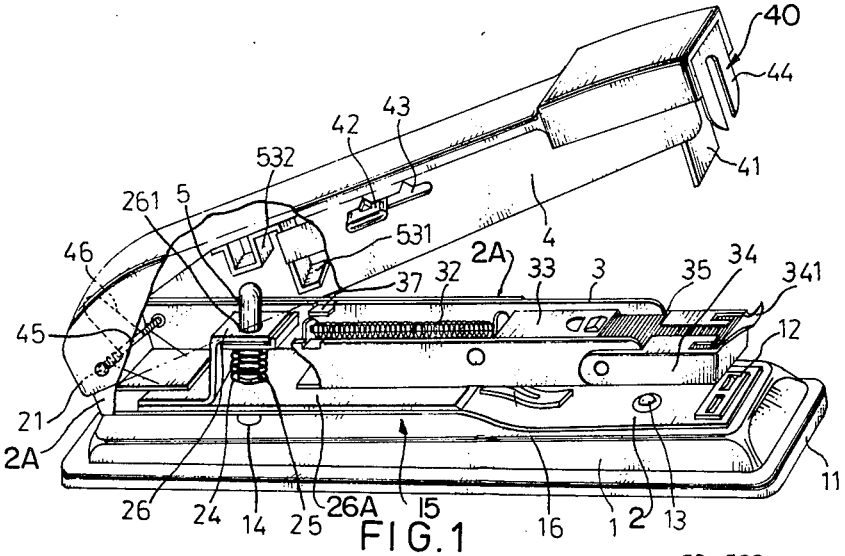
FIG. 1 depicts a preferred embodiment of the multi-purpose stapler of the present invention in a perspective view with a partial cut away view of the inside construction to show the punch in its stand-by position ready for punching or staple removing. A front portion of a bracket side 2A is removed to expose interior components of the stapler.

Referring to FIG. 1, the multi-purpose stapler of the present invention comprises a base 1, a supporting bracket 2, a staple magazine 3, a press handle 4, a staple remover assembly 40 and a hole punch 5.

The hollow space 1A provided under the base 1 serves to collect paper scraps resulting from punched holes. Under the base a plastic cover 11 is snapped thereon. A staple clinching die 12 is disposed near the front end of the base. Supporting bracket 2 is fixed on base 1 with rivet 13. At the rear end of bracket 2 the bracket sides 2A. and the staple magazine 3 by a pin 45. On the pin 45, a coil spring 46 is provided to bias the press handle 4 so as to return handle 4 back to its rest position i.e., wherein the bottom of a stapling blade 41 is located above the staples in the magazine 3, after completion of an operation. On the horizontal surface of the bracket 2 and located under the staple magazine 3, a leaf spring 16 is provided as a buffer to return the staple magazine 3 to a horizontal position after each stapling operation. The staple magazine 3 is retained in a horizontal position by detents on the sides of bracket 2. In the rear section of staple magazine 3, a coil spring 32 is provided to force a staple pusher 33 against a row of staples 35, so that the front most staple will be positioned at the forward end of the magazine. Directly above the front most staple is the stapling blade 41, with both the stapling blade and front most staple being aligned directly above clinching die 12. These arrangements are conventional and no further discussion is warranted.

Figure 3:
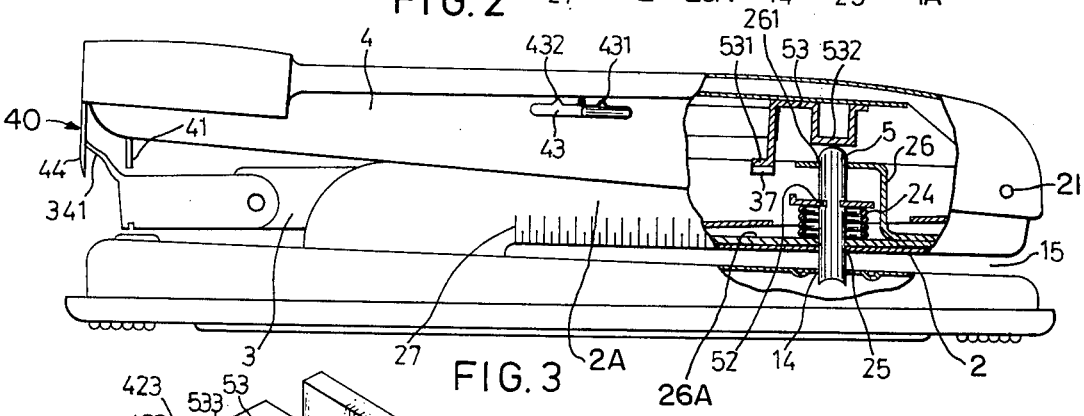
FIG. 3 is a side elevation of the same embodiment with a partial cut-away to show the punching actuator shifted rearward to an actuating position and the handle compressed in the direction of the base, thereby both the punch and the staple remover are in an actuating position.

A bearing plate 26 is provided at the rear section of the bracket 2 on a plate 26A which is carried by the bracket 2. The upper end of a punch rod 5 extends through hole 26l of the bearing plate 26. At the middle section of punch rod 5, a spring retainer 52 is provided to receive a coil spring 24 biasing the punch rod 5. The lower end of the punch rod 5 is sharp and extends through hole 25 formed at the rear bottom of the bracket 2. The punch rod 5 guided by the holes 26l and 25, is moved down by pressing the handle 4 wherein a wall 532 of punching actuator 53 engages the top of the punch rod 5 the rod 5 is returned by spring 24. At the rear section of base 1, directly under the punch rod 5, a punch receiving aperture 14 is provided which is aligned with the lower sharp end of punch rod 5. Clearance 15 between base 1 and bracket 2 is for inserting paper to be punched. Graduations 27 are provided on the sides of bracket 2 right above the clearance 15 to guide the depth of the insertion of paper into clearance 15. In FIG. 3 the lower end of punch rod 5 is engaged with punch receiving aperture 14.

Figure 2:
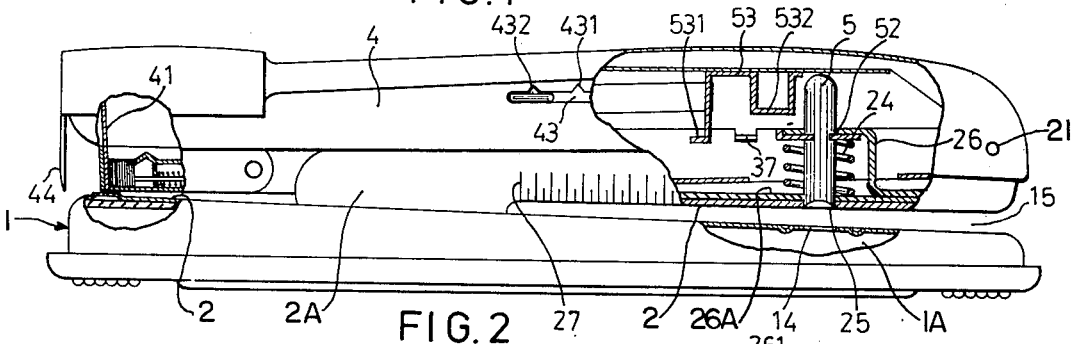
FIG. 2 is a side elevation of the same embodiment with a partial cut-away to show the punching actuator shifted forward to a suspension position and the handle compressed in the direction of the base, thereby depicting the stapler in its actuated position.

One of the features of the present invention is the capability of shifting the punch actuator between a rearward and a forward position. Referring also to FIGS. 2 and 3, a slot 43 is provided in the middle section of the press handle 4. A pair of plastic buttons 42 in the slot 43 are connected to the punching actuator 53 which is slidable along the hollow space under handle 4, and the details of which shall be detailed later in FIGS. 4 and 5. The punching actuator 53 is positioned to selectively engage or release the punch rod 5 by shifting the buttons 42 rearward or forward.

A U-shaped member 34 is welded to the front end of staple magazine 3. The staple remover assembly 40 comprises a jaw member 44 and a pincer tip 341. At the middle section of member 34, the pincers tip 341 protrudes upward to form the lower jaw of the staple remover assembly. Member 44 forms the upper jaw of the staple remover assembly and can be fabricated by bending down the front most portion of press handle 4. The pair of jaws is operable as a staple remover. In FIG. 3 tip 341 and member 44 are shown in engaged position. The downward movement of the handle 4 is limited by the engaging of the punching actuator 53 with the top of the punch rod 5 when the spring 24 bottoms-out. In FIG. 3 the unit is being used as a punch or staple remover and the stapling blade 41 is in suspension i.e., it cannot engage a staple.

Figure 4:
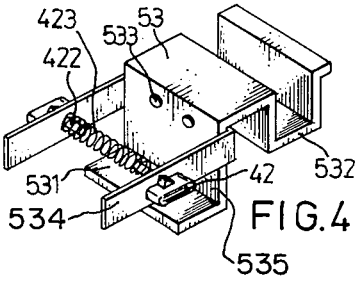
FIG. 4 is a perspective view showing the punching actuator alone which is detached from under the press handle.
Figure 5:
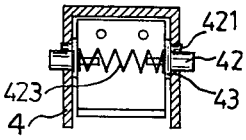
FIG. 5 is a front cross sectional view of the punching actuator.

Now referring to FIGS. 4 and 5, the punching actuator is longitudinally shaped like a square headed sine curve. The front leg 531 of the actuator 53 is of less width than the other legs at the top of an arm 535 which carries the leg 531 is welded at points 533 a U shaped spring bracket 534. A button 42 with lock projection 421 and a horizontal pin 422 is fixed on each leg of U shaped spring bracket 534. The buttons 42 carry the actuator 53 and are slidably retained in the hollow space under the press handle 4 with buttons 42 being shiftable within the slots 43 as aforementioned. Between horizontal pins 422, a coil spring 423 is retained to keep legs of the U shaped bracket 534 stretched against the inside wall of the press handle 4. Along an upper side of the slot 43, notches 431 and 432 are provided to receive the lock projection 421 on button 42 so as to maintain the active or inactive position of the actuator 53.

A pair of stoppers 37 are fabricating by bending section of the top edge of staple magazine 3 inwardly at corresponding locations. The projecting leg 531 of punching actuator 53 rests on the stoppers 37 with the actuator engaging the punch rod 5 and thereby limits the downward depression of the handle 4 to cause the suspension of stapling action, as shown in FIG. 3. In FIG. 2, the punch rod 5 is released from engagement with actuator 53, and thereby the stapling function is active.

The stapler is loaded by swinging the handle 4 upwardly relative to the magazine 3 above the axis of the pin 45, retracting the staple pusher 33 rearwardly, and inserting a block of staples ahead of the pusher 33. To perform a stapling function, the actuator 53 is shifted forwardly, so that the leg 531 is located forwardly of the stoppers 37. In this fashion, the handle 4 can be depressed to the position shown in FIG. 2 to eject a staple. To punch a hole in paper, the paper is inserted into the clearance 15 and beneath the punch rod 5. The handle 4 is raised and the actuator 53 is moved rearwardly so that the wall 532 overlies the punch rod 5. By depressing the handle 4, the punch rod 5 is pushed through the paper. In the same position of the actuator 53 a staple can be removed by raising the handle 4 and positioning the staple between the jaw 44 and pincer tips 341. By depressing the handle 4 the staple is removed and the stoppers 37 stop the handle in the position shown in FIG. 3 so that the staple can be dislodged from the jaw and pincer tips.

The multi-purpose stapler as described above, with stapler, staple remover and hole punch with shiftable actuator provided on a common base, is extremely compact and convenient to use. The shiftable actuator with button lock means ensures a positive action without being loosened after a considerable time of use.

The above embodiment is given only for purposes of illustration and not by way of limitation and modification will become evident to those skilled in the art which will fall within the scope of the attached claims.

We claim:

1. A multi-purpose stapler of the type having one mode of operation wherein hole-punching and staple-removing functions are afforded and another mode of operation wherein a stapling function is afforded, said stapler comprising:

a base including a punch-receiving aperture at one end and a staple clinching die at another end, supporting bracket including a front portion fixedly mounted on said base, and a rear portion spaced from said base to define a clearance for reception of material to be punched, said rear portion including a hole aligned with said aperture, a staple magazine pivotably mounted to a rear portion of said bracket, a press handle pivotally mounted to a rear portion of said bracket and including longitudinal slots at the middle thereof, a pair of buttons slidably mounted in said slots, a punching actuator connected to said buttons and disposed within said handle for movement between first and second positions, stop means positioned on said magazine to be operably engageable with said actuator when said actuator is in said first position to limit downward movement of said handle to a first level and nonengageable with said actuator when said actuator is in said second position to allow downward movement of said handle beyond said first level to a second level, a bearing plate mounted on a rear portion of said bracket and including a hole aligned with said aperture and said hole in said bracket, a punch rod slidably received in said holes and biased away from said aperture, said punch rod positioned for being depressed downwardly beyond said aperture by a contact portion of said actuator only when said actuator is in said second position, so that hole punching may occur only when actuator is in said second position, a vertical stapling blade mounted at a front end of said press handle above a forwardmost staple in said magazine, the length of said blade being such that the blade acts downwardly against said forwardmost staple and drives it from said magazine only when said handle is moved downwardly to said second level, so that stapling occurs only when said actuator is in said second position, an upper jaw depending from a front end of said press handle forwardly of said stapling blade, a lower jaw comprising a U-shaped member including legs fixedly mounted to a front end of said staple magazine and a middle portion projecting upwardly, said upper jaw and middle portion being oriented to merge together and remove a staple when said press handle is lowered to said first level, so that staple removing occurs when said actuator is in said first position.

2. A multi-purpose stapler according to claim 1, wherein said punching actuator is shaped in the longitudinal direction as a square headed sine wave including a plurality of horizontal sections, a forwardmost section being shorter in the longitudinal direction than the other sections and situated below said other sections, a U-shaped bracket including a pair of legs mounted on said actuator, said bracket legs disposed within said press handle adjacent inside walls thereof, said buttons each including a lock projection and a horizontal pin, said buttons being mounted on said bracket legs such that said pins are directed toward one another and such that said buttons extend through said slots in said press handle, said slots including notches on an upper side thereof for receiving said lock projections of said buttons to retain said buttons in a pair of positions corresponding to said first and second positions, a coil spring disposed between and bearing against said bracket legs to urge said bracket legs against the inside walls of said press handle.

3. A multi-purpose stapler according to claim 2, wherein said staple magazine includes a pair of stopper members defining said stop means, said front sections of said actuator being arranged to abut said stopper members when said actuator is in said first position.

* * * * *